US011837803B2

(12) United States Patent
Reinhardt et al.

(10) Patent No.: US 11,837,803 B2
(45) Date of Patent: Dec. 5, 2023

(54) CHICLETS FOR A CHICLET CONNECTOR

(71) Applicants: TE Connectivity Nederland BV, s'Hertogenbosch (NL); TE Connectivity India Private Limited, Bangalore (IN); TE Connectivity Germany GmbH, Bensheim (DE)

(72) Inventors: Marc Reinhardt, Bensheim (DE); Guenther Mumper, Bensheim (DE); Christian Rusch, Bensheim (DE); Bert Bergner, Bensheim (DE); Srinivas Rathod, Bangalore (IN); Rutger Wilhelmus Smink, s'Hertogenbosch (NL); Jabobus Nicolaas Tuin, s'Hertogenbosch (NL); Anne Weiss, Bensheim (DE); Samir Aboulkassem, Bensheim (DE); Deeksha Venkadari Yogendra, Bensheim (DE); Christian Mandel, Bensheim (DE); Daniel Volkmann, Bensheim (DE); Gregor Karrasch, Bensheim (DE)

(73) Assignees: TE Connectivity Nederland BV, S-Hertogenbosch (NL); TE Connectivity India Private Limited, Bangalore (IN); TE Connectivity Germany GmbH, Bensheim (DE)

( * ) Notice: Subject to any disclaimer, the term of this patent is extended or adjusted under 35 U.S.C. 154(b) by 63 days.

(21) Appl. No.: 17/473,223

(22) Filed: Sep. 13, 2021

(65) Prior Publication Data

US 2022/0085533 A1 Mar. 17, 2022

(30) Foreign Application Priority Data

Sep. 11, 2020 (DE) ..... 102020123799.5
Sep. 10, 2021 (EP) ..... 21196162

(51) Int. Cl.
*H01R 12/72* (2011.01)
*H01R 13/6587* (2011.01)
*H01R 107/00* (2006.01)

(52) U.S. Cl.
CPC ..... *H01R 12/725* (2013.01); *H01R 12/728* (2013.01); *H01R 13/6587* (2013.01); *H01R 2107/00* (2013.01); *H01R 2201/04* (2013.01)

(58) Field of Classification Search
CPC ..... H01R 12/725; H01R 12/728; H01R 13/6587; H01R 2107/00; H01R 2201/04
(Continued)

(56) References Cited

U.S. PATENT DOCUMENTS 5,577,935 A * 11/1996 Harting ..... H01R 24/50 439/578
5,679,006 A * 10/1997 Madelaine ..... H01R 13/6585 439/63
(Continued)

FOREIGN PATENT DOCUMENTS

CN 209709297 U 11/2019
CN 111478088 A 7/2020
(Continued)

OTHER PUBLICATIONS

German Office Action, dated Apr. 30, 2021, 5 pages.
(Continued)

*Primary Examiner* — Alexander Gilman
(74) *Attorney, Agent, or Firm* — Barley Snyder

(57) ABSTRACT

A chiclet for a chiclet connector includes a conductor having a first end and a second end. A housing of the chiclet encloses and defines a housing interior. The conductor extends through the housing interior with the first and second ends of the conductor forming contacts projecting from the housing. The housing forms an electromagnetic
(Continued)

shield electrically insulated from the conductor. A support of the chiclet corresponds in shape to the housing interior and is connected to the conductor for fixing the conductor within the housing.

19 Claims, 5 Drawing Sheets

(58) Field of Classification Search
USPC ..... 439/79
See application file for complete search history.

(56) References Cited

U.S. PATENT DOCUMENTS

| | | | | |
|---|---|---|---|---|
| 6,358,062 | B1 * | 3/2002 | Feldman | H01R 24/50 439/63 |
| 7,811,128 | B2 * | 10/2010 | Pan | H01R 12/00 439/607.05 |
| 8,366,485 | B2 * | 2/2013 | Johnescu | H01R 12/737 439/607.09 |
| 9,022,806 | B2 * | 5/2015 | Cartier, Jr. | H01R 13/6587 439/607.07 |
| 9,634,434 | B1 * | 4/2017 | Pao | H01R 13/6471 |
| 10,476,210 | B1 * | 11/2019 | Trout | H01R 13/6587 |
| 10,804,654 | B1 * | 10/2020 | Chen | H01R 13/6587 |
| 11,621,530 | B2 | 4/2023 | Lloyd et al. | |
| 2013/0017725 | A1 * | 1/2013 | Davis | H01R 13/6587 439/607.55 |
| 2014/0194004 | A1 * | 7/2014 | Pickel | H01R 13/6587 439/607.01 |
| 2016/0134057 | A1 * | 5/2016 | Buck | H01R 13/6471 439/607.05 |
| 2020/0266585 | A1 * | 8/2020 | Paniagua | H01R 13/652 |
| 2021/0376533 | A1 * | 12/2021 | Wei | H01R 13/6591 |

FOREIGN PATENT DOCUMENTS

| | | | |
|---|---|---|---|
| DE | 695 00 379 | T2 | 1/1998 |
| EP | 0 488 482 | A1 | 6/1992 |
| JP | 2000331748 | A | 11/2000 |
| JP | 2018503228 | W | 2/2018 |
| JP | 2019197637 | A | 11/2019 |

OTHER PUBLICATIONS

Japanese Office Action with English translation, Application No. 2021-148322, dated Oct. 4, 2022, 12 pages.
Indian Examination Report, Application No. 202144041158, dated Mar. 22, 2022, 5 pages.
Extended European Search Report, Application No. 21196162.8-1201, dated Feb. 3, 2022, 8 pages.
Office Action from Japan's Patent Office dated Apr. 18, 2023, with English translation thereof, corresponding to Application No. 2021-148322, 6 pages.
Korean Office Action dated Jun. 21, 2023, with English translation thereof, corresponding to Application No. 10-2021-0121929, 10 pages.

* cited by examiner

CHICLETS FOR A CHICLET CONNECTOR

CROSS-REFERENCE TO RELATED APPLICATIONS

This application claims the benefit of Patent Application No. DE 10 2020 123 799.5 filed on Sep. 11, 2020, and European Patent Application No. EP 21196162 filed on Sep. 10, 2021, the whole disclosures of which are incorporated herein by reference.

FIELD OF THE INVENTION

The present invention relates to electrical connectors, and more particularly to chiclets for a chiclet connector or a chiclet header.

BACKGROUND

In the electrical arts, the term "chiclet" or "chicklet" has been adopted to describe modules that are inserted side-by-side into a connector housing to build-up a connector strip. Chiclets or chiclet connectors are usually used in the field of data communication and associated devices, i.e., in devices for high-frequency data transmission. The chiclet connectors are plugged onto carriers, such as circuit boards or cards with integrated circuits, so called integrated circuit boards (ICBs). While widely used, current chiclet designs have proven unsuitable for use in applications subject to high vibrations, shock loads and/or high temperature fluctuations.

Accordingly, there is a need for improved chiclets and associated chiclet connectors which are able to withstand these harsh conditions, while maintaining high-frequency and high data rate operations.

SUMMARY

According to an embodiment of the present disclosure a chiclet for a chiclet connector includes a conductor having a first end and a second end. A housing of the chiclet encloses and defines a housing interior. The conductor extends through the housing interior with the first and second ends of the conductor forming contacts projecting from the housing. The housing forms an electromagnetic shield electrically insulated from the conductor. The chiclet further includes a support corresponds in shape to the housing interior and connected to the conductor for fixing the conductor within the housing.

BRIEF DESCRIPTION OF THE DRAWINGS

The invention will now be described by way of example with reference to the accompanying Figures, of which.

DETAILED DESCRIPTION OF THE EMBODIMENTS

Figure 1:
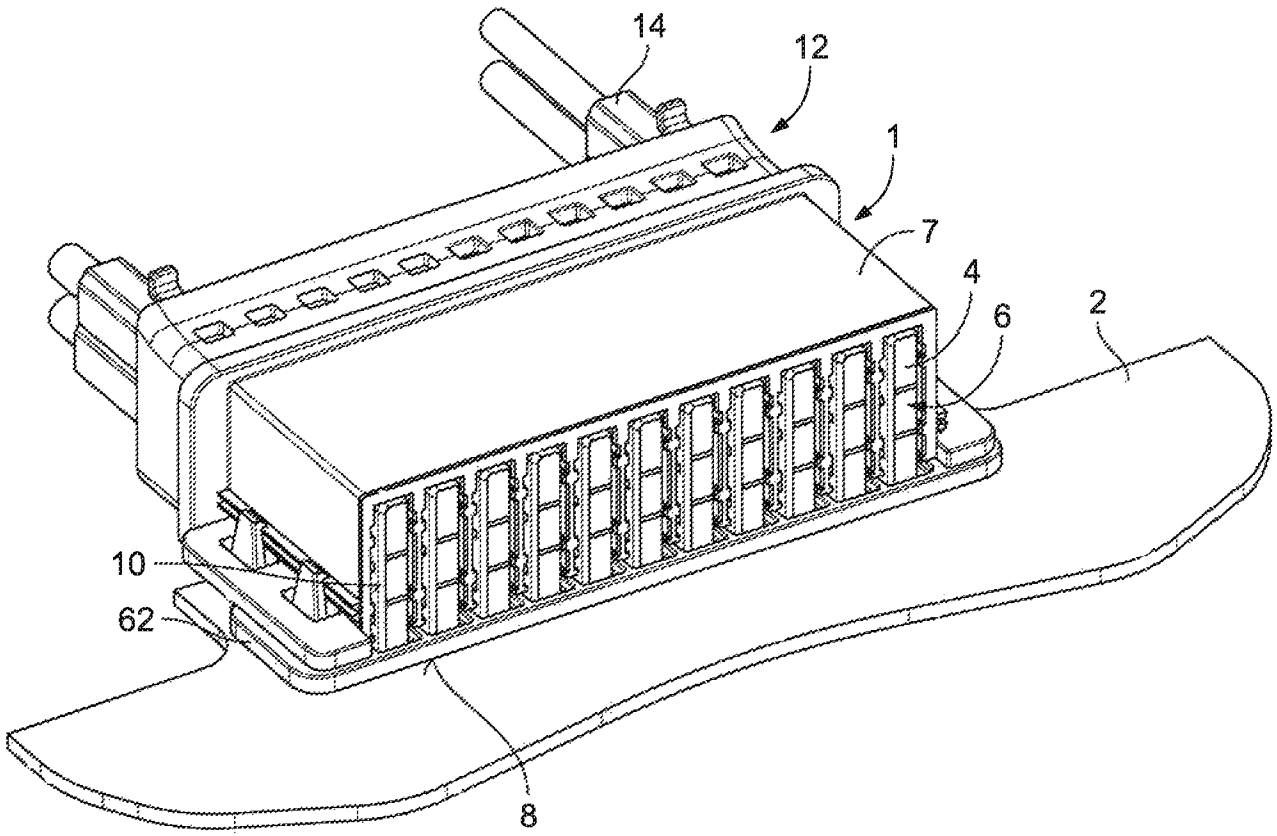
FIG. 1 is a schematic perspective view of a chiclet connector with chiclets mounted on a support.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring generally to FIG. 1, embodiments of the present disclosure include a chiclet connector 1 mounted on a carrier 2, for example an ICB. A plurality of chiclets or modules 4 are inserted side by side in receptacles 6 arranged in the chiclet connector 1. The individual chiclets 4 stand on edge on a mounting plane 8, with their flat sides 10 facing opposing each other. A mating connector 12 complementary to the chiclet connector 1 is shown in an inserted state. The mating connector 12 can be equipped with exchangeable contact modules 14 corresponding to and engaging with the chiclets 4. Depending on the type of chiclets 4 used, the chiclet connector 1 can be adapted to different applications. A housing 7 may be arranged over the receptacles 6 and secured to the mounting plane 8 in the illustrated manner.

Figure 2:
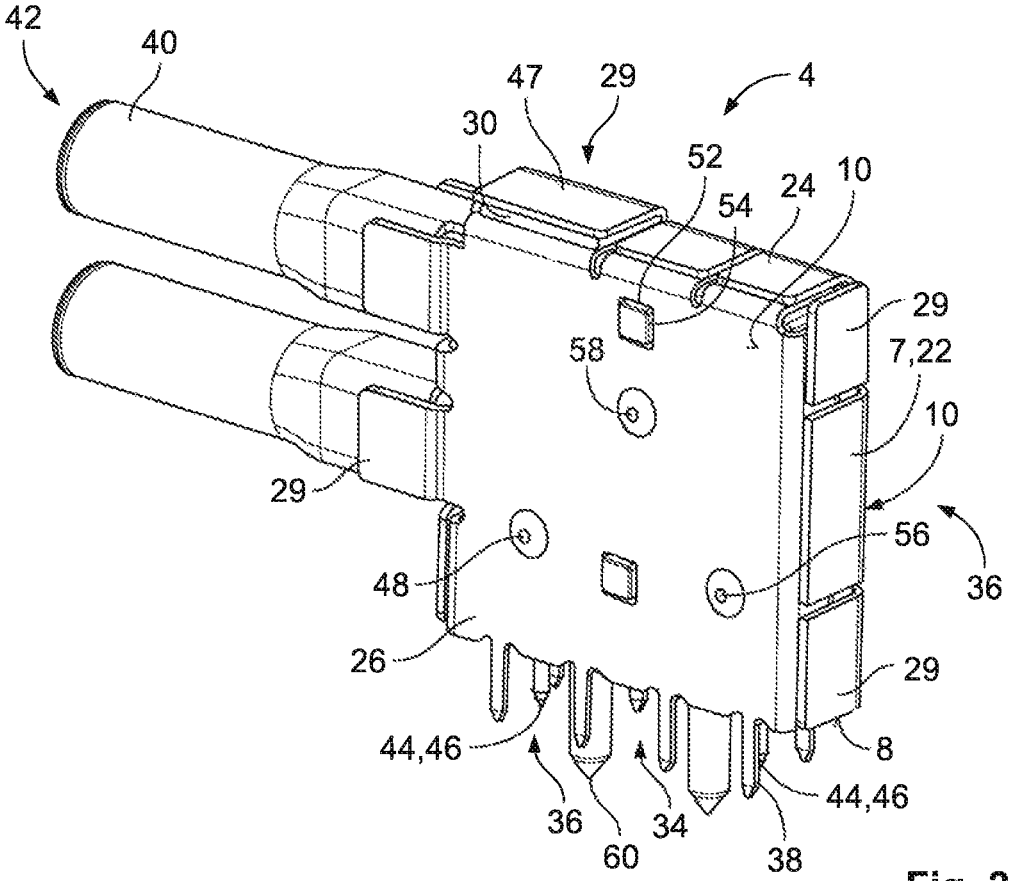
FIG. 2 is a schematic perspective view of a chiclet.

FIG. 2 is a rear perspective view of the chiclet 4. The chiclet 4 has high frequency shielding 22 that may form part of the housing 7 shown in FIG. 1. In the exemplary embodiment of FIG. 2, however, the housing 7 is embodied a separate sub-housing of each chiclet 4. The housing 7 is a stamped/bent part that can be made from a single piece of sheet metal. In the illustrated embodiment, the housing 7 is made of two housing halves 24, 26 that are joined or plugged together. In order to achieve effective high frequency shielding, the housing halves 24, 26 overlap in areas where a housing gap 30 is defined between the housing halves 24, 26. In particular, one or a plurality of, for example, rectangular housing tabs 29 may be provided in areas in which the housing halves 24, 26 overlap. The housing halves 24, 26 may be joined to each other by a material bond (e.g., adhesive bonding, welding, soldering, etc.) and/or by a form fit. The housing 7 surrounds a housing interior 32 (see FIG. 3) preferably on all sides. In one embodiment, one side 34, in particular a side facing the mounting plane 8 or, in the assembled state, the carrier 2, can remain open. In particular, the side 34 is a narrow side 36 of the otherwise cuboid housing 7. The shape of the housing 7 is not limited to a cuboid, however. The housing 7 may be generally in the form of a parallelepiped. Individual sides of the housing 7 may, of course, also be rounded or curved if required by a given application. The areas where the housing halves 24, 26 overlap when viewed from the housing interior 32 are preferably located on one or all of the narrow sides 36.

The chiclet 4 may form one or a plurality of pin-like housing extensions 38 on the side 34 lying in the mounting plane 8 of the chiclet 4. The housing extensions 38 of the housing 7 are preferably an integral or monolithic component of the housing halves 24, 26, or of the material of the housing 7. They serve to be inserted into corresponding openings of the carrier and soldered thereto. The openings of the carrier 2 are preferably lined with an electrically conductive material and also serve to shield or establish an electrical contact between the housing 7 and a fixed potential provided on the carrier side. At the same time, the housing extensions 38 serve to fix the chiclet 4 and the chiclet connector 1 to the carrier 2.

The housing 7 may be provided with at least one shielding sleeve 40 projecting away from the housing 7. The shielding sleeve 40 is open at its end 42 facing away from the housing 7. The shielding sleeve 40 forms a cavity into which a conductor 44 of the chiclet 4 extends. As shown in FIG. 2, only one end of the conductor 44, which protrudes on the side 34 and forms a contact 46, can be seen. The contact 46, which protrudes from the housing 7 from the side 34, serves to be inserted into a corresponding mating contact of the carrier 2. The shielding sleeve 40 can be a separate component that is connected to the housing 7 in a material and/or form-fitting manner. However, the shielding sleeve 40 may also be integrally formed by a housing half 24, 26. Alternatively, both housing halves 24, 26 can also form the shielding sleeve 40 together. The number of conductors 44 in the chiclet 4 is determined by the particular application. The same applies to the number of shielding sleeves 40. For illustration purposes only, FIGS. 2-5 show two conductors 44 and correspondingly two shielding sleeves 40. The number of shielding sleeves 40 can also be smaller than the number of conductors 44 of a chiclet 4.

Figure 3:
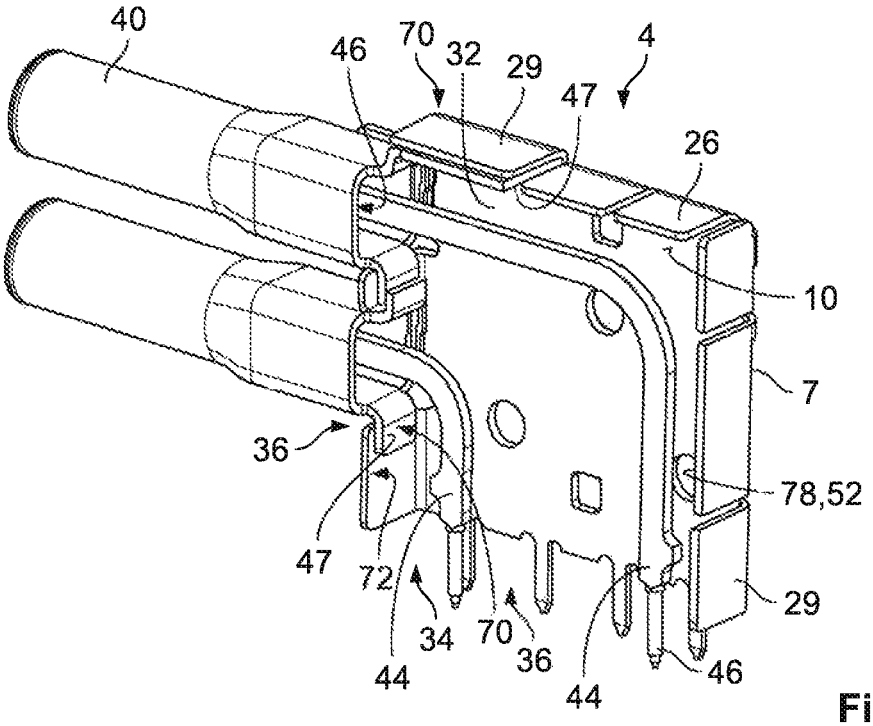
FIG. 3 is a schematic perspective view of the interior of the chiclet of FIG. 2.

Referring to FIGS. 2 and 3, in one embodiment the shielding sleeve 40 is a separate part that is joined to the housing 7 or the housing halves 24, 26. The shielding sleeve 40 and the housing overlapping in areas where there is a gap 72 between the shielding sleeve and one or both housing halves 24, 26 in order to achieve effective shielding even in the high-frequency range. In order to produce overlaps with the housing 7, the shielding sleeve 40 may be formed with, for example, rectangular tabs 47. In particular, the tab 47 may overlap with one of the housing tabs 29. The overlaps between the housing halves 24, 26 or their housing tabs 29 and/or the overlaps between the tabs 47 of the shielding sleeve 40 and the housing tabs preferably take place exclusively on one or more of the narrow sides 36 of the chiclet 2. The housing tabs 29 and the tabs 47 of the shielding sleeve 40 may simultaneously serve as fasteners. For example, welding or bonding may join the housing tabs 29 together and/or the housing tabs 29 to the tabs 47.

The chiclet 4 has a support 48 arranged in the housing interior 32, which is connected to the housing 7 in a positive-fitting and/or a material-fitting manner. The support 48 is preferably made of a plastic which has a heat resistance of at least 240° C., and preferably of more than 260° C., so that the conductor 44 can be connected to the corresponding mating contact of the support by means of a joining process with a high heat input, such as reflux soldering. The connection between the support 48 and the housing 7 preferably takes place on one or both flat sides 10 of the housing 7. For example, the housing 7 may have one or more openings or holes 52 on its flat sides 10, into which or through which a corresponding projection 54 of the support 48 projects. The openings 52 and projections 54 are merely two examples of positive-fitting or positively-engaging elements by which the support 48 is held in position in the housing 7 and is vibration and shock resistant. In particular, the projection 54 may form a plastic rivet 56 that is monolithically formed from the support 48. The support 48 and housing 7 are riveted together in this manner. Specifically, at reference numeral 58, a projection forming a plastic rivet is shown prior to hot riveting (see FIG. 4). At reference numeral 56, the riveted plastic rivet is shown (see FIG. 5).

The support 48 may further include or define one or more pin-shaped support extensions 60 that protrude from the housing 7 on the side 34 or the side of the mounting plane 8. The support extensions 60 may be used to additionally secure the chiclet 4 to the support 2 via the support 48, for example by hot riveting. As shown in FIG. 1, in one embodiment, the extensions 38, 60 of the housing 7 and support 48 serve to attach to a platform 62 which may be located between the carrier 2 and chiclet connector 1 or may be part of the chiclet connector 1 and form its mounting plane 8, or to the carrier 2 through such a platform 62. In a variation of the embodiment described above, the side 34 of the housing 7 need not be open, but may be covered at least in sections by the housing 7 if improved shielding is required on that side. The at least one contact 46 and the support extensions 60 may then protrude from the side 34 through openings formed in the housing 7.

FIG. 3 shows the chiclet 4 of FIG. 2 with the housing half 26 removed and without the support 48 installed or formed therein. As shown, the conductor 44 extends continuously through the housing interior 32 and projects through two narrow sides 36 of the housing 7 that are aligned orthogonally to one another. The portions of the conductor 44 projecting from the housing 7 thereby form the contacts 46 for contacting complementary contacts of the mating connector 12 or the carrier 2 (see FIG. 1). Specifically, one contact 46 is surrounded by the shielding sleeve 40 and is used for contacting corresponding mating contacts (not shown) of the mating connector 12. The other contact 46 projects out of the side 34 and is used for contacting a mating contact provided by the carrier 2, for example, in the form of a socket or hole (not shown).

The effectiveness of the shielding of the housing 7 and the shielding sleeve 40 changes with the position of the conductor 44 in the housing 7 or in the shielding sleeve 40. Thus, if the conductor 44 vibrates relative to the housing 7 in an environment subject to vibration or shock, the shielding effect changes with time. Therefore, in order to use the chiclet 4 at high data rates and in environments subject to vibration or shock, the position of the conductor 44 relative to the housing 7 is fixed by the support 48.

Figure 4:
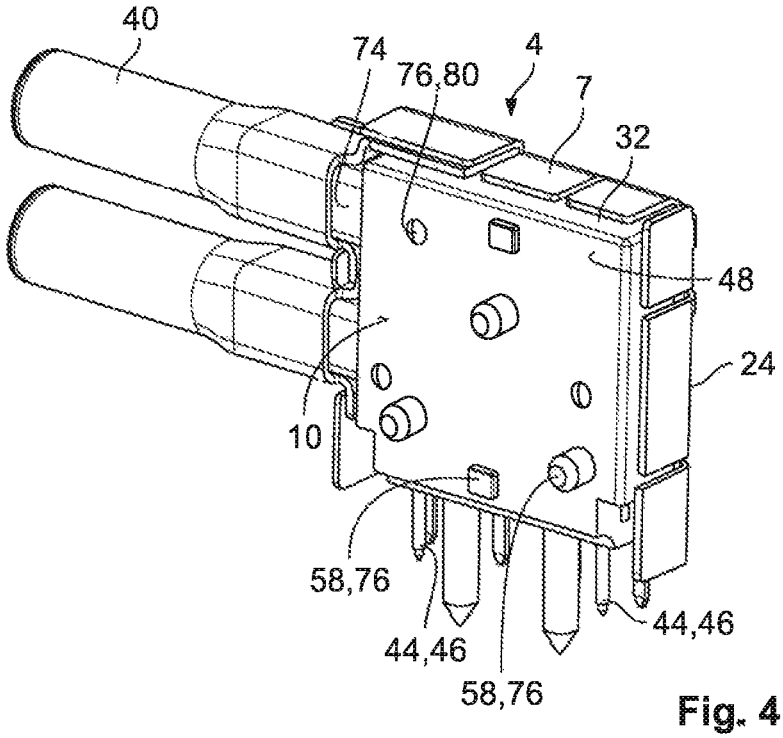
FIG. 4 is a schematic perspective view of the chiclet of FIG. 2 with one half of the housing removed.

The support 48 is shown in more detail in FIG. 4, in which the chiclet of FIG. 2 is shown without the housing half 26. The support 48 may be injection molded around the conductors 44, which are preferably held in the lead frame, prior to insertion into the housing 7. Consequently, the support 48 and the conductors 44 form a part which can be handled as a single piece and which, in the assembly process, is inserted as a whole into the housing half 24 or the housing 7 which has not yet been finished. As can be seen, the support 48 extends at least in sections into the shielding sleeve 40. The shielding sleeve 40 may likewise already be fitted onto the support 48 in the course of assembly and be joined together therewith as a pre-assembled part with the housing 7 or the housing half 24. In this case, the support 48 has, for example, a stub-shaped extension 74 extending from the housing interior 32 into the shielding sleeve 40. The conductor 44 is embedded within the extension 74. The extension 74 fixes the position of the conductor 44 in the shielding sleeve 40. For this purpose, the extension 74 can be pressed into the shielding sleeve 40 or the shielding sleeve 40 can be pressed onto the extension 74 of the support 48.

Instead of the support 48 being molded around the conductor 44, the support 48 may comprise two or more parts which are fitted together. The conductor 44 can be inserted into such a support before the individual parts are joined together. In this case, the individual parts may be connected to each other by positive-fit (e.g., press-fit) and/or material-fit. In such an embodiment, bonding and/or ultrasonic welding of the parts of the support 48 is suitable.

The support 48 preferably completely fills the housing interior 32, thus having a shape complementary to the housing interior. The housing interior 32 may have substantially the shape of the housing 7, i.e., may be parallelepipedal or generally parallelepipedal. On the flat side 10, as discussed above, the support 48 has positive locking elements 76 in the form of projections 58 which cooperate with correspondingly complementary shaped positive locking elements 52, 78 (see FIG. 3) of the housing 7 and secure the position of the support 48 relative to the housing. In addition to the projections 58, the support 48 can also have recesses or depressions 80 as positive locking elements 76, which interact with corresponding complementary positive locking elements or positioning aids of the housing 7. The positive-locking elements of the support 48 can also serve to fix the chiclet 4 in the chiclet connector 1 by engaging in complementarily configured positive-locking elements of the chiclet connector 1. In addition to or instead of a positive connection, a material connection may also be provided between the support 48 and the housing 7. For example, the support 48 may be welded or bonded to the housing 7.

Figure 5:
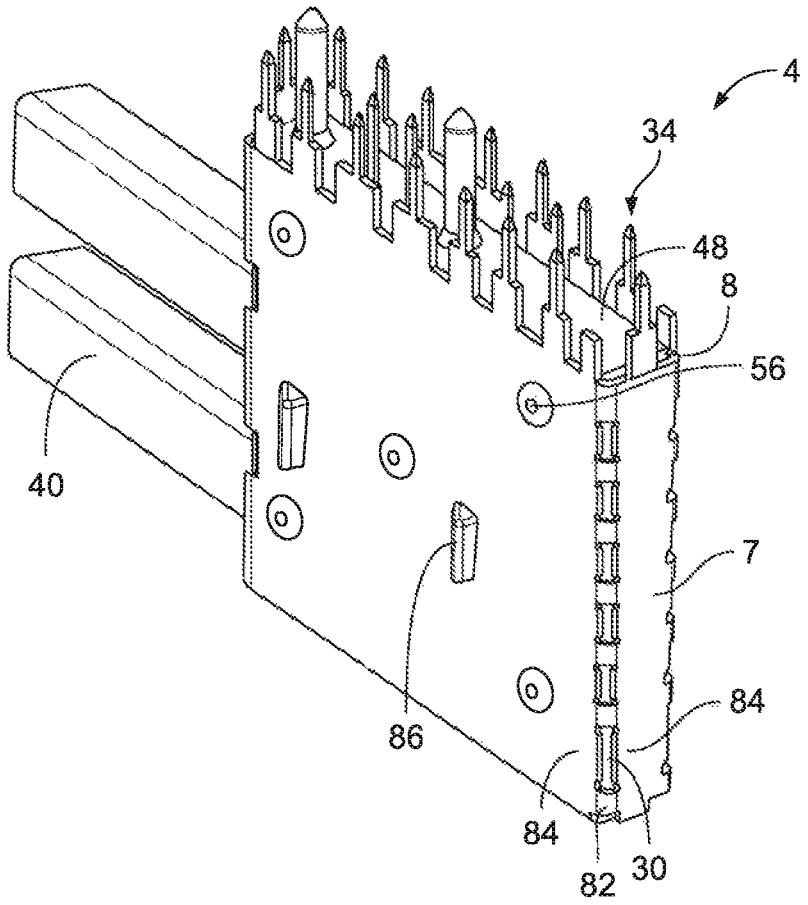
FIG. 5 is a schematic perspective view of another chiclet.

FIG. 5 shows a chiclet header whose housing 7, together with the shield extensions 40, is monolithically formed from a single piece of sheet metal. The exemplary embodiment may utilize a differential contact compared to the, for example, coaxial contact(s) of the chiclet 4 of FIGS. 2-4. The manufacturing method of the housing 7 is independent of the contact or circuit form in which the chiclet 4 is used. To save material, the monolithic housing 7 is provided with material bridges 82 made of an electrically conductive material, for example a solder, weld metal or adhesive, which bridges opposing sections 84 between which there is a housing gap 30. Thus, the use of housing tabs can be eliminated.

The housing 7 of FIG. 5 also has a housing structure 86, for example in the form of a projection or alternatively in the form of a recess, which is used for positive fixing and/or positioning in a chiclet connector 1. Such a housing structure 86 may also be present in the embodiment of FIGS. 2-4. Alternatively or additionally, a section of the support projecting through the housing 7, for example the projection 54 or the plastic rivet 56, can also serve to position the chiclet 4 in the chiclet connector 1.

Figure 6:
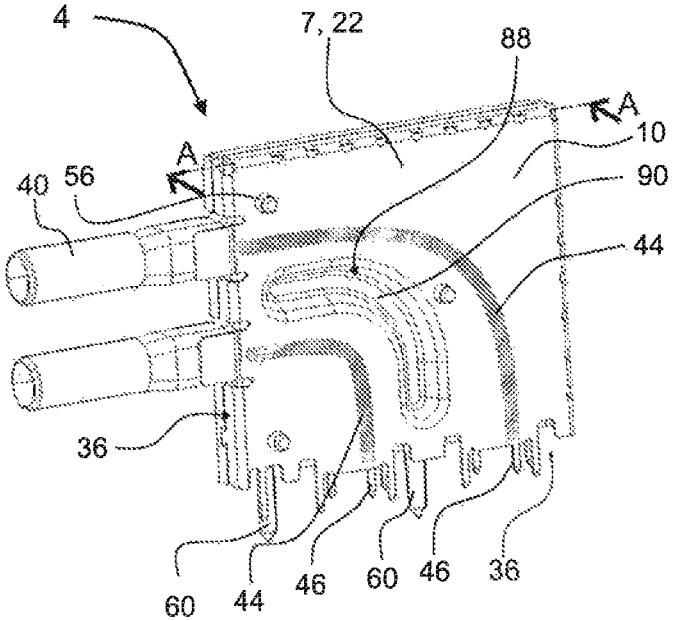
FIG. 6 shows a schematic perspective view of a further embodiment of the chiclet.
Figure 7:
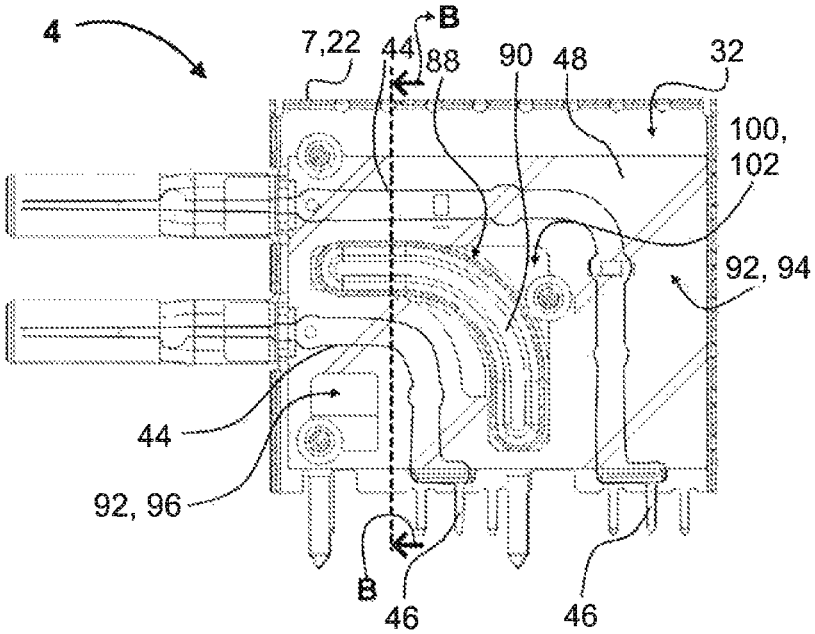
FIG. 7 shows a schematic sectional view of the chiclet of FIG. 6 along A-A.
Figure 8:
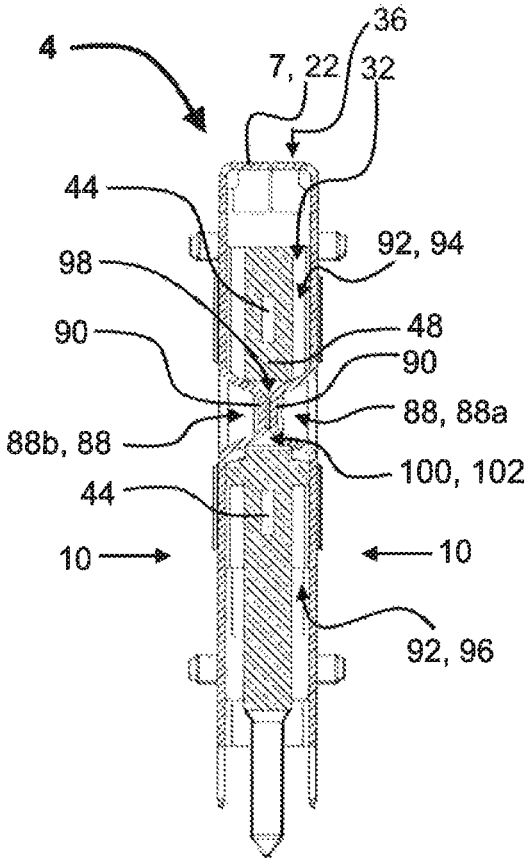
FIG. 8 shows a schematic sectional view of the chiclet of FIG. 6 and FIG. 7 along B-B.

In FIGS. 6-8, a further embodiment of the chiclet 4 according to the invention is shown in perspective and two sectional views. Basic features of the chiclet 4 correspond to those of the figures described above. Thus, chiclet 4 also has a housing 7 which serves as a high frequency shielding 22 and which encloses a support 48 (see FIG. 7).

In FIG. 6 a position of the two conductors 44 is schematically indicated. These extend from a narrow side 36, on which the shielding sleeve 40 is provided, to a narrow side 36, on which the contacts 46 formed by the conductor as well as the support extensions 60 are formed.

The housing 7 of the shown embodiment of the chiclet 4 has a depression 88 which projects between the two conductors 44 into the housing interior 32 (see FIG. 7). The depression 88 further comprises a bottom 90 and extends in a curved manner from one narrow side 36 to a second narrow side 36, so that the depression 88 is always located between the two conductors 44. The at least one depression may be formed by mechanically processing the housing, i.e. by bending, deep-drawing, punch-drawing or similar forming processes.

FIG. 7 shows a sectional view along A-A (see FIG. 6) in which the two conductors 44 are indicated. In the embodiment shown, the conductors 44 are cast or molded into the support 48. In other embodiments, the conductors 44 may not be cast, but merely held in or by the support 48.

As the depression 88 extends into the housing interior 32, two shielded sub-regions 92 are formed with a conductor 44 disposed in each shielded sub-region 92. In other embodiments (not shown), more than two conductors 44 may be provided, each with a depression 88 located between two adjacent conductors 44. Thus, the two conductors 44 are shielded from harmful or disturbing interaction between the two conductors 44. Mutual interference may thus be reduced or prevented. A shielded sub-region may contain two, three, four or more conductors. In an exemplary embodiment, two conductors may be utilized in parallel, i.e. transmitting the same signal. Thus, there may be provided more than one conductor per channel. Each depression may form two channels that are shielded against one another. Any number of conductors may be provided in each of the channels.

FIG. 8 shows a sectional view along B-B (see FIG. 7) in which the two shielded sub-regions 92, a first shielded sub-region 94 and a second shielded sub-region 96 are visible. Furthermore, FIG. 8 shows that a depression 88 extends from each flat side 10 into the housing interior 32. A first depression 88*a* faces a second depression 88*b*, and a gap 98 may be formed between the bottoms 90 of the two depressions 88*a*, 88*b*. In other embodiments, both bottoms 90 may contact each other and completely shield the two shielded sub-regions 92 from one another. In another embodiment it is possible that the first depression 88*a* extends from one flat side 10 to the opposite flat side 10, such that no second depression 88*b* is necessary.

In FIGS. 7 and 8, the support 48 also has a support depression 100. In the embodiment of chiclet 4, the support depression 100 is designed as a support opening 102, into which the two depressions 88*a* and 88*b* of the housing 7 extend. According to the invention, a thinned-out region of the support 48 may be located in the gap 90 in some embodiments of the chiclets 4 (not shown).

In different embodiments of the inventive chiclet, any combination and any number of the above described embodiments of the depression may be combined. Thus, in one exemplary embodiment one and the same housing of the chiclet may comprise a first depression extending from one flat side to the opposite inner side of the housing either touching said opposite inner side or being located at a distance to said inner side and the same housing of the chiclet may further comprise a second and third depression that oppose each other and extend into the housing interior from opposite sides. Also this pair of depressions may touch each other or may be located at a distance to one another (forming a gap). Thus, different embodiments of the depression may be provided at different locations in the housing.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A chiclet for a chiclet connector, comprising:

a conductor having a first end and a second end;

a housing enclosing a housing interior, the conductor extending through the housing interior with the first and second ends of the conductor forming contacts projecting from the housing, the housing forming an electromagnetic shield electrically insulated from the conductor, the housing has at least one housing gap at which two housing sections lie opposite one another, the two housing sections being connected by at least one electrically conductive material bridge bridging the housing gap; and a support corresponding in shape to the housing interior and connected to the conductor for fixing the conductor within the housing.

2. The chiclet of claim 1, wherein the conductor extends through the support and the support fixedly engages with a sidewall of the housing.

3. The chiclet of claim 2, wherein one of the support or the housing defines an opening, and the other one of the support or the housing defines a protrusion received through the opening for securing the support within the housing.

4. The chiclet of claim 3, wherein the support and the housing are connected to each other by at least one plastic rivet.

5. The chiclet of claim 4, wherein the at least one plastic rivet is a monolithic component of the support.

6. The chiclet of claim 1, wherein the support has at least one extension on one side thereof projecting from the housing.

7. The chiclet of claim 1, wherein the support is overmolded around the conductor.

8. The chiclet of claim 1, further comprising at least one shielding sleeve extending away from the housing and surrounding one of the contacts of the conductor.

9. The chiclet of claim 8, wherein the at least one shielding sleeve is electrically connected to the housing and includes an open end facing away from the housing.

10. The chiclet of claim 8, wherein the support extends at least partially into the at least one shielding sleeve.

11. The chiclet of claim 8, wherein the shielding sleeve is formed by at least one of two joined housing halves defining the housing.

12. The chiclet of claim 1, wherein the housing includes two joined housing halves, the housing halves overlapping at least at regions at which the housing gap is located between the housing halves.

13. The chiclet of claim 1, wherein the housing is monolithically constructed of a sheet metal.

14. The chiclet of claim 1, wherein the support defines a support extension extending through an open side of the housing for securing the chiclet to a carrier.

15. A chiclet connector, comprising:

a connector housing defining a plurality of receptacles;

a plurality of chiclets each arranged within a respective one of the receptacles, each chiclet including:

a conductor having a first end and a second end;

a chiclet housing defining a housing interior, the conductor extending through the housing interior with the first and second ends of the conductor forming contacts projecting from the housing, the housing forming an electromagnetic shield electrically insulated from the conductor, the housing has at least one housing gap at which two housing sections lie opposite one another, the two housing sections being connected by at least one electrically conductive material bridge bridging the housing gap; and a support arranged within the housing interior and connected to the conductor for fixing the conductor within the housing.

16. The chiclet connector of claim 15, wherein the support defines a support extension extending through the chiclet housing for securing the chiclet connector to a carrier.

17. The chiclet connector of claim 16, wherein the support defines a plurality of protrusions extending in a direction distinct from the support extension, and the chiclet housing defines a plurality of openings, each of the plurality of protrusions received within a corresponding one of the plurality of openings for fixing the support relative to the chiclet housing.

18. The chiclet connector of claim 15, wherein the support surrounds at least a portion of the conductor.

19. The chiclet connector of claim 15, wherein the chiclet housing defines at least one shielding sleeve extending away from the housing and surrounding a contact end of the conductor, the support extending at least partially into the at least one shielding sleeve.

* * * * *